United States Patent [19]

Walker

[11] Patent Number: 4,662,097

[45] Date of Patent: May 5, 1987

[54] TRIGGER OPERATED BARREL LOCK RELEASE

[75] Inventor: Hylton R. Walker, Pinetown, South Africa

[73] Assignee: Aserma Manufacturing a division of O.M.C. Aserma (Proprietary) Limited, New Germany, South Africa

[21] Appl. No.: 874,543

[22] Filed: Jun. 16, 1986

[30] Foreign Application Priority Data

Jun. 14, 1985 [ZA] South Africa ..... 85/4517

[51] Int. Cl.[4] ..... F41C 11/02

[52] U.S. Cl. ..... 42/44

[58] Field of Search ..... 42/44, 12, 13, 64, 63

[56] References Cited

U.S. PATENT DOCUMENTS

| | | | |
|---|---|---|---|
| 349,244 | 9/1886 | Waters | 42/44 |
| 756,039 | 3/1904 | Mossberg | 42/44 |
| 802,803 | 10/1905 | Ellstrom | 42/44 |
| 832,660 | 10/1906 | Ellstrom | 42/44 |
| 895,057 | 8/1908 | Stendbach | 42/44 |

*Primary Examiner*—Deborah L. Kyle
*Assistant Examiner*—Michael J. Carone
*Attorney, Agent, or Firm*—Ladas & Parry

[57] ABSTRACT

A firearm has a barrel which is pivotal upwardly and forwardly relative to a frame to render a rear of the barrel accessible. A latch mechanism latches the barrel in a closed position and is operable to release the barrel to allow pivoting. The firearm has a trigger which is displaceable from a rest position, rearwardly to actuate a firing mechanism, and forwardly. The trigger has a release formation arranged, when the trigger is displaced forwardly, to engage and operate the latch mechanism to release the barrel.

4 Claims, 4 Drawing Figures

TRIGGER OPERATED BARREL LOCK RELEASE

This invention relates to a firearm and to a method of operating a firearm.

In accordance with the invention, there is provided a firearm including a frame;

a barrel pivotally mounted on the frame about a lateral pivot axis;

a latch mechanism adapted to latch the barrel to the frame in a closed position, such as for firing, and which is releasable to allow the barrel to be pivoted to an open position in which the rear of the barrel is accessible, such as for loading and unloading;

a firing mechanism having a trigger which is displaceable from a rest position, rearwardly to actuate the firing mechanism, and forwardly; and a release formation on the trigger and arranged, when the trigger is displaced forwardly, to release the latch mechanism.

The latch mechanism, when latching the barrel in its closed position, may resiliently be biassed against releasing. The latch mechanism may then resiliently bias the trigger via the release formation to its rest position.

The invention extends to a method of operating a firearm having a frame;

a barrel pivotally mounted on the frame about a lateral pivot axis;

a latch mechanism adapted to latch the barrel to the frame in a closed position, such as for firing, and which is releasable to allow the barrel to be pivoted to an open position in which the rear of the barrel is accessible, such as for loading; and a firing mechanism having a trigger displaceable rearwardly from a rest position to actuate the firing mechanism, the method including, when the barrel is latched in its closed position, displacing the trigger forwardly from its rest position to engage and to release the latch mechanism, to allow the barrel to be pivoted to its open position.

The invention is now described by way of example with reference to the accompanying diagrammatic drawings. In the drawings FIG. 1 shows, in three dimensional view from in front and from one side, a firearm in accordance with the invention;

Figure 1:
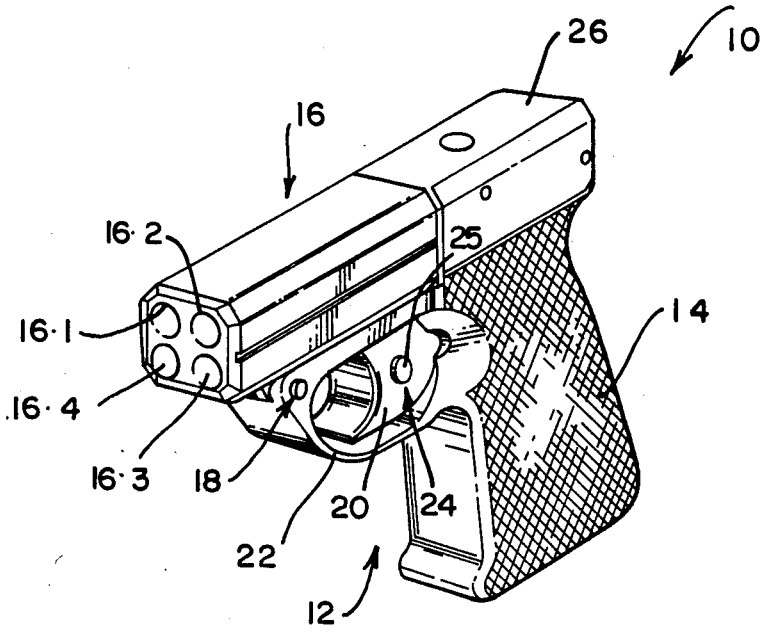
Figure 2:
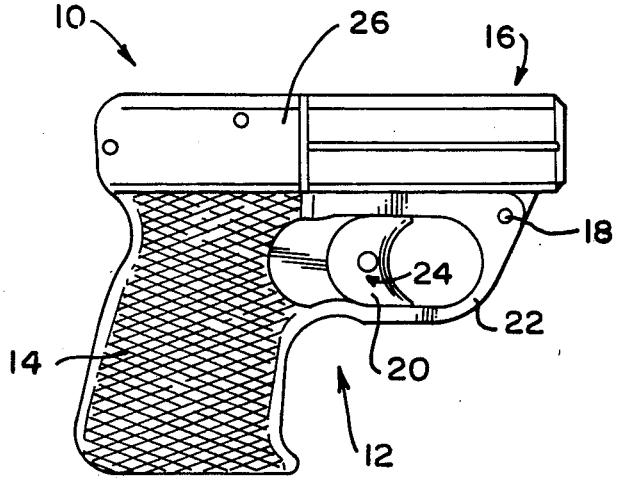
FIG. 2 shows a side view from another side of the firearm of FIG. 1.

With reference to FIGS. 1 and 2 of the drawings, a firearm in accordance with the invention is generally in the form of a pistol 10 and is more specifically a derringer.

The pistol 10 includes a frame generally indicated at 12, a hand grip 14 and a composite barrel 16 comprising four barrels 16.1, 16.2, 16.3 and 16.4. The barrels will herein collectively be referred to as the barrel 16. The composite barrel 16 is pivotal with respect to the frame 12 as indicated at 44 about a transverse, decumbent pivot pin 18 disposed toward the front of the pistol 10. Thus, the rear of the composite barrel 16 is pivotal upwardly to render it accessible. The pistol 10 further includes a trigger 20 guarded by means of a trigger guard 22 and a safety catch 24 mounted in the trigger 20.

A breech 26 is accommodated within the frame 12 immediately rearward of and aligned with the barrel 16.

Figure 3:
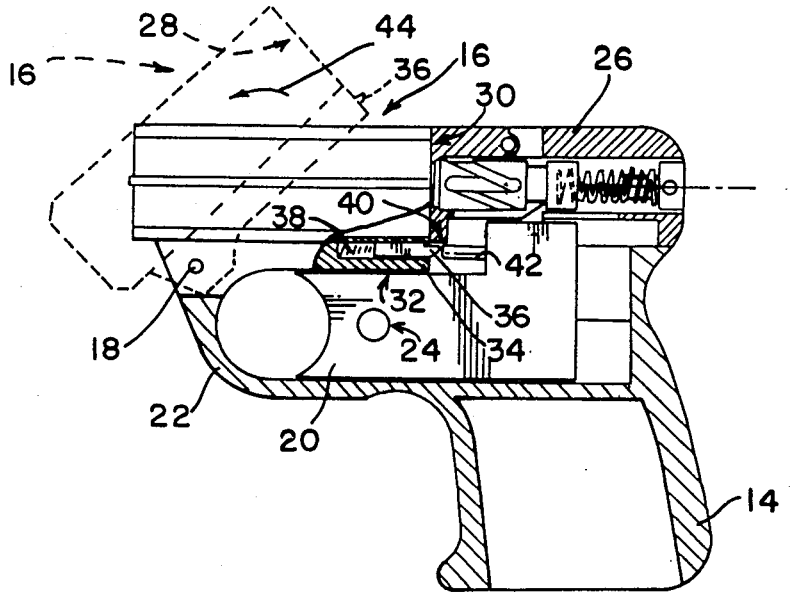
FIG. 3 shows, in sectional side view, the firearm of FIG. 1.
Figure 4:
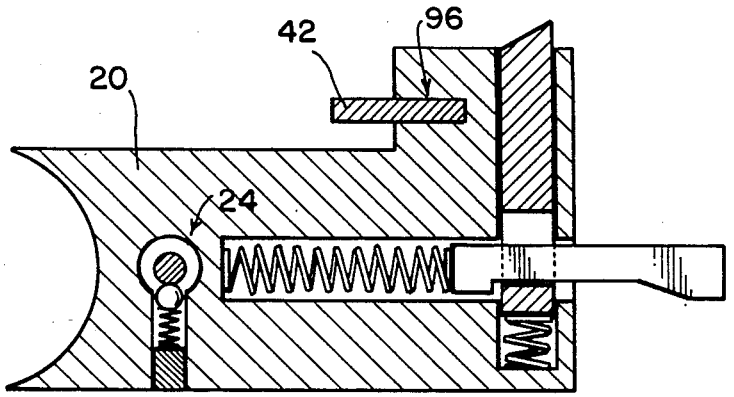
FIG. 4 shows, in sectional side view, to a larger scale a trigger and cocking mechanism of the firearm of FIG. 1.

With reference to FIGS. 3 and 4, upward and forward pivoting of the composite barrel 16 is described in more detail.

A rear face 28 of the composite barrel 16 lies against (with little clearance) a front face 30 of the breech 26 when the composite barrel 16 is closed. The composite barrel 16 has, underneath the barrels 16.3 and 16.4, a longitudinal socket 32 accommodating a latch pin 34 which is spring biassed rearwardly by means of a spring 38 accommodated in compression between the bottom of the socket 32 and the rear of the latch pin 34. The latch pin 34 has a nose 36 standing proud of the face 28.

The breech 26 has a shoulder 40 complemental to the nose 36. When the composite barrel 16 is pivoted to a closed position, the nose at 36 abuts the face 30 of the breech 26 and is urged inwardly into the socket 32 against the bias of the spring 38. When the barrel 16 is in its closed position, the nose 36 clears the shoulder 40 at the lower end of the face 30 and is free to move outward to project from the face 28 under its bias. The nose 36 hooks underneath the shoulder 40 and the composite barrel 16 cannot be pivoted upwardly while the nose 36 is projecting.

Fixed to the trigger 20, there is provided a release member in the form of a pin 42 projecting forward and aligned with the latch pin 34. When the trigger 20 is in its rest position and the nose 36 projects beyond the rear face 28, the nose 36 and the leading end of the pin 42 are spaced with little clearance.

To unlatch the composite barrel 16 to allow it to be pivoted, the trigger 20 is moved forward from its rest position. The pin 42 abuts the nose 36 and urges the latch pin 34 into its socket 32. Thus, the nose 36 clears the shoulder 40 and the front face 30 of the breech and the composite barrel can be pivoted.

Latching and unlatching of the composite barrel 16 with respect to the breech in accordance with the invention are advantageous in that the latching mechanism is very simple and inexpensive, and in that an unauthorised user of the pistol, who will probably not be familiar with such a pistol, will find it difficult to work out how to open the barrel to reload the pistol.

I claim:

1. A firearm including a frame;

a barrel pivotally mounted on the frame about a lateral pivot axis;

a latch mechanism adapted to latch the barrel to the frame in a closed position, such as for firing, and which is releasable to allow the barrel to be pivoted to an open position in which the rear of the barrel is accessible, such as for loading and unloading;

a firing mechanism having a trigger which is displaceable from a rest position, rearwardly to actuate the firing mechanism, and forwardly; and a release formation on the trigger and arranged, when the trigger is displaced forwardly, to release the latch mechanism.

2. A firearm as claimed in claim 1 in which the latch mechanism, when latching the barrel in its closed position, is resiliently biassed against releasing.

3. A firearm as claimed in claim 2 in which the latch mechanism resiliently biasses the trigger via the release formation to its rest position.

4. A method of unlatching the barrel of a firearm having a frame;

a barrel pivotally mounted on the frame about a lateral pivot axis;

a latch mechanism adapted to latch the barrel to the frame in a closed position, such as for firing, and which is releasable to allow the barrel to be pivoted to an open position in which the rear of the barrel is accessible, such as for loading; and a firing mechanism having a trigger displaceable rearwardly from a rest position to actuate the firing mechanism, said method comprising displacing the trigger forwardly from its rest position to engage and to release the latch mechanism, to allow the barrel to be pivoted to its open position.

* * * * *